US005458163A

United States Patent [19]

Lindenmüller et al.

[11] Patent Number: 5,458,163

[45] Date of Patent: Oct. 17, 1995

[54] CASSETTE APPARATUS FOR PRESENTING WEFT THREADS TO A WEFT THREAD INSERTION MEMBER IN A LOOM

[75] Inventors: Walter Lindenmüller, Lindau; Rainer Schuster, Sigmarszell, both of Germany

[73] Assignee: Lindauer Dornier Gesellschaft mbH, Lindau, Germany

[21] Appl. No.: 282,968

[22] Filed: Jul. 29, 1994

[30] Foreign Application Priority Data

Aug. 2, 1993 [DE] Germany ..... 43 25 905.7

[51] Int. Cl.[6] ..... D03D 47/38

[52] U.S. Cl. ..... 139/453

[58] Field of Search ..... 139/453

[56] References Cited

U.S. PATENT DOCUMENTS

| | | | |
|---|---|---|---|
| 3,542,085 | 11/1970 | Haltmeier | 139/453 |
| 3,587,665 | 6/1971 | Monge | 139/453 |
| 4,191,222 | 3/1980 | Marshall | 139/453 |
| 4,313,472 | 2/1982 | Weidmann | 139/453 X |
| 4,785,856 | 11/1988 | Gehring et al. . | |
| 5,090,457 | 2/1992 | Corain et al. | 139/453 |
| 5,172,735 | 12/1992 | Kleiner . | |

FOREIGN PATENT DOCUMENTS

| | | | |
|---|---|---|---|
| 2255918 | 6/1974 | Germany | 139/453 |

*Primary Examiner*—Andrew M. Falik
*Attorney, Agent, or Firm*—W. G. Fasse; W. F. Fasse

[57] ABSTRACT

A weft thread or weft threads are selected from a plurality of weft thread supply spools in a shuttleless loom for presenting the selected weft thread or weft threads to the gripper of the gripper rod. In order to equip each loom with the required number of weft selector and needle moving devices and in order to make these devices exchangeable, the individual selector and needle moving devices are constructed as insert cassettes which are exchangeable against one another as desired. For this purpose the exchangeable cassette which is equipped with an electric drive motor and preferably also with a control for the electric drive motor, is combined with a carrier and guide mechanism for supporting the cassette and guiding the respective weft presenting needle. Each cassette comprises at least one weft presenting needle and each cassette is individually connected in a releasable manner to the carrier and guide mechanism and independently of all other cassettes.

18 Claims, 3 Drawing Sheets

CASSETTE APPARATUS FOR PRESENTING WEFT THREADS TO A WEFT THREAD INSERTION MEMBER IN A LOOM

FIELD OF THE INVENTION

The invention relates to devices for presenting a weft thread selected from a plurality of weft threads to the gripper of a gripper rod or rapier in a loom, whereby the selection of a particular thread from a group of threads shall be simplified by improved weft selector and needle moving devices.

BACKGROUND INFORMATION

The weft threads are supplied from supply spools in shuttleless looms operating with weft insertion and withdrawal gripper rods. The particular weft thread presently to be inserted is selected by a special weft selector device for presentation to the gripper of the gripper rod in such a position that the gripper can seize the thread for insertion into the loom shed. The weft selector device includes a weft presenting needle for each of the individual weft thread pulled off the supply spools. These needles have a needle eye at their free ends for holding the respective weft thread. The thread presenting needles are moved from a rest position into a work position and back again, whereby the work position is specific for each weft presenting needle yet enabling the seizing of the thread by the gripper. Several constructions of the just described mechanism are known in the art. However, for present purposes only those mechanisms are relevant for the weft thread selection and presentation in which the weft threads are guided and presented by linearly displaceable weft presenting needles. U.S. Pat. No. 4,785,856 (Gehring et al.) discloses an apparatus for presenting weft threads to a gripper in shuttleless looms. U.S. Pat. (Gehring et al.) is based on German Patent (DE-PS) 3,618,445. In the known device weft threads are presented to a gripper by needles, each of which is guided by at least one straight needle guide held askew in a needle guide carrier. The straight needle guides due to their askew arrangement make sure that all needles together are located in and displaceable in a fan-type plane twisted in space. In the working position of each needle the respective needle eye is located on a short line extending approximately in parallel to the gripper path. Thus, all weft threads in their presenting position are close to each other in a narrow presenting zone within the reach of the gripper path for a sure transfer and gripping at the beginning of the forward gripper motion at which time the gripper speed is still slow so that the weft threads are gripped gently. The straight needle guides held askew in the at least one guide carrier form a row of guides which is slanted by a given angle relative to the gripper pass to form the fan-type plane twisted in space. A second row of askew straight guides may be arranged in a second carrier. The straight guides in the known mechanism are arranged in a section of the carrier in a row and the further straight guides are positioned in another row in a guide section of the mechanism, whereby the two rows form such an angle relative to each other that the straight guides of both rows guide the needles to be positioned in the fan-type plane twisted in space. The just described weft presenting mechanism has the advantage that the positions where the gripper can seize the presented thread are located close to each other from the first to the last weft thread available for selection so that the weft thread seizing can take place with a relatively small gripper stroke with an exact, almost point position thread presentation to the gripper of the rod. Yet, there is room for improvement, especially with regard to the exchange of the thread selecting and presenting components from loom to loom.

European Patent Publication EP 0,478,986 A1 corresponding to U.S. Pat. No. 5,172,735 (Kleiner) discloses a weft thread selecting and supplying device with an electronically controllable electric motor which drives a drive wheel which in turn drives a drive belt that is looped around the drive wheel and a guide wheel. The belt carries thread presenting needles that are driven back and forth between a ready position and a thread presenting position for the respective weft thread. The apparatus of the just mentioned European Patent Publication includes a housing in which the drive belt is driven in a slipless manner. The drive belt is looped around a drive wheel and a guide wheel having a defined diameter difference between the diameter of the drive wheel and the diameter of the guide wheel, as well as a defined on-center spacing between these wheels. Due to the different wheel diameters, straight lines that extend the respective drive belt run, intersect in a point and the weft presenting needle that is secured to each of the two drive belt runs, is moved with its needle eye into that point for presenting the weft thread to the gripper, whereby one needle is in a standby position and the other is in the thread transfer position. These positions of the needles are positively exchanged simply by rotating the drive wheel. However, the apparatus of Kleiner can also work with but one thread presenting needle connected to just one of the runs of the drive belt. In both instances, the electric motor rotates the drive wheel in accordance with a pattern being woven and in synchronism with the weaving cycle so that the drive wheel moves the drive belt accordingly. One thread presenting needle is positively positioned in the standby or in the presenting position. Two needles are repeatedly exchanged when the motor is driven in one direction or in the opposite direction.

In the device of Kleiner the electric motor can be controlled independently of the loom control to stop a weft thread supply, for example when the loom is stopped in response to the detection of a faulty warp thread or a faulty weft thread.

OBJECTS OF THE INVENTION

In view of the above it is the aim of the invention to achieve the following objects singly or in combination:

- to maintain the advantages of the above known devices while increasing the adaptability of these devices to various operating requirements of shuttleless looms;
- to equip a loom in accordance with its particular weaving conditions so that only the required number of weft selector and needle moving devices is employed to avoid idling devices;
- to construct the weft selector and needle moving devices in the form of exchangeable or insertable cassettes so that these cassettes are compatible with even different types of looms and so that only the required number of cassettes may be used for any particular weaving operation; and
- to simplify the exchange of these cassettes and thus the selection of the weft thread and the weft thread supply in such a way that minimal down times are assure.

SUMMARY OF THE INVENTION

The present apparatus is characterized by the combination of a spatially adjustable carrier and guide mechanism for weft presenting needles with an electric motor driven weft selector and needle moving device which comprises at least one weft moving needle and which is constructed as an independently exchangeable insert cassette so that the weft selector and needle moving device can be independently inserted in or removed from the carrier and guide mechanism. The invention has the advantage that the weft selector and needle moving cassettes are independent of the other loom components and that each of these cassettes can be constructed and handled independently of any of the other loom components. Each of these cassettes comprises a connector piece, for example in the form of a guide sleeve or bushing that forms on the one hand a straight guide for the respective weft presenting needle which passes through the sleeve. On the other hand, the guide bushing constitutes a plug-in connection between the carrier and guide mechanism and the insert cassette. Once the bushing or sleeve is in the proper inserted position, the position can be arrested, for example, by a set screw or the like.

It is an important advantage of the invention that each individual loom may now be equipped only with that number of effective weft selector and needle moving devices that are necessary for the particular type of loom or for the particular type of weaving to be done on the loom. Moreover, the individual insertable and exchangeable cassettes are exchangeable from loom to loom in accordance with the requirements of the particular loom for such cassettes.

BRIEF DESCRIPTION OF THE DRAWINGS

In order that the invention may be clearly understood, it will now be described, by way of example, with reference to the accompanying drawings, wherein.

DETAILED DESCRIPTION OF PREFERRED EXAMPLE EMBODIMENTS AND OF THE BEST MODE OF THE INVENTION

Figure 1:
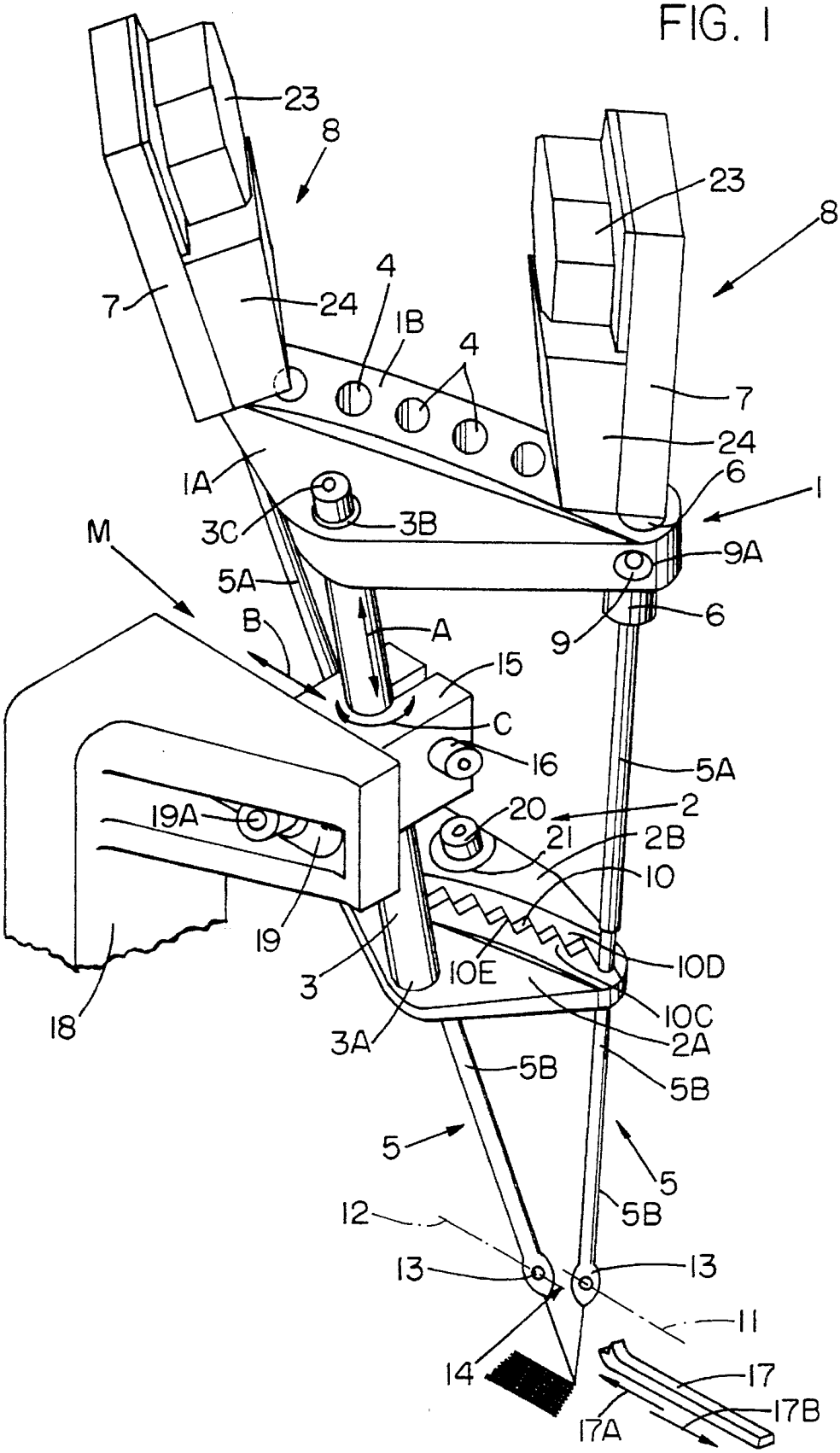
FIG. 1 shows a perspective view of a spatially adjustable carrier and guide mechanism in combination with two weft selector and needle moving devices each provided with its own electromotor driven weft inserting needle, whereby only two positions of the eight positions of the carrier and guide mechanism are occupied by two weft selector and needle moving devices.

FIG. 1 shows a guide and carrier mechanism M combined with two weft selector and needle moving devices or cassettes 8. The mechanism M comprises a carrier member 1 and a guide member 2 connected to each other by a connector rod 3 secured to a mounting bracket 18 which in turn is connected to the loom frame not shown. The carrier member 1 and the guide member 2 are preferably curved in space as is known from U.S. Pat. No. 4,785,856 mentioned above.

The carrier member 1 comprises a first mounting section 1A secured to the upper end 3B of the connector rod 3, for example by a screw connection 3C. The carrier member 1 further comprises a socket section 1B having, for example, eight straight through-bores forming guide sockets 4 for guide sleeves or bushings 6. As shown, the guide bushings 6 pass with a guide fit through the sockets 4. However, the through-bores may be provided with a shoulder to form a positive stop for the respective bushing 6. For example, only two of the eight sockets 4 are occupied by respective bushings 6 which carry housings 7 of weft selector and needle moving devices 8 constructed according to the invention as insert cassettes. For this purpose, each housing 7 is secured to the respective guide bushings 6 that fit into any of the sockets 4 with a guide fit. Each housing 7 carries an electric motor 23 for moving the respective thread presenting needle or needles 5 and preferably also a control 24 for controlling the operation of the electric motor with a respective program. The needle drive mechanism inside the housing 7 may be of the type described above with reference to U.S. Pat. No. 5,172,735 (Kleiner). Once the guide bushing 6 that extends out of the housing 7 is properly positioned within its guide socket 4, the entire cassette unit 8 is fixed in its position 9 by a set screw 9A. The set screw 9A may be replaced by a wing screw or the like for an easy exchange of one cassette 8 against another cassette 8.

Each weft presenting needle 5 is axially guided in the bushing 6 which in turn is guided in its socket 4. A further axial guide for each needle is provided in the straight guide member 2 having a plurality of straight guide passages 10 with a rectangular or square passage cross-sectional area as will be described in more detail below. For this purpose the needles 5 have a lower portion 5B with a respective cross-sectional area and configuration corresponding to that of the straight guide passages 10. The upper portion 5A of the needles 5 have a cross-sectional area and configuration fitting slidingly into a respective guide bore in the bushings 6. The cross-section of the upper needle portion 5A is, for example, round.

The right-hand needle 5 in FIG. 1 carries in its eye 13 a weft thread 11 while the left-hand needle carries in its eye 13 a weft thread 12. Both weft threads 11 and 12 are to be seized by the gripper of the gripper rod 17 moving back and forth into the loom shed and out again as indicated by the arrow 17A and 17B. In this example the threads 11 and 12 form a so-called double weft. The eyes 13 at the ends of the needles 5 define the length and position of an imaginary line 14 on which the eyes 13 of all needles 5 of an insert cassette 8 are positioned when these eyes are in their working position.

Referring further to FIG. 1 the carrier mechanism M will now be described. The connector rod 3 is mounted in a slotted block 15 which in turn is secured to a mounting bracket 18 secured to the loom frame not shown. The slotted block 15 is adjustable in its position up and down along the connecting rod 3 as indicated by the arrow A when a tightening clamp or screw 16 is loose. At that time the block 15 is also adjustable rotationally around the connecting rod 3 as indicated by the arrow C. When the screw or clamp 16 is tightened, the block 15 assumes a fixed position relative to the connecting rod 3. A third adjustment indicated by the arrow B, of the block 15 relative to the mounting bracket 18 is possible with the help of an elongated slot 19 in the bracket 18 when a tightening clamp or screw 19A is loosened. Once the proper position is established, the screw or clamp 19A is tightened. Thus, the position of the block 15 can be adjusted in six directions as indicated by the double arrows A, B, and C.

The guide member 2 is connected to the lower end 3A of the connecting rod 3. Thus, the adjustments of the position of the block 15 as just described make it possible to position the angle of the line 14 relative to the path of the gripper rod 17 by varying the position of the entire mechanism M relative to the gripper rod movement indicated by the arrows 17A and 17B.

FIG. 1 also illustrates one embodiment of the guide member 2 having a first guide section 2A and a second guide section 2B. These guide member sections 2A, 2B are equipped with serrations 10C and 10D respectively, differing from serrations 10A and 10B shown in FIGS. 2 and 3. The serrations 10C of the guide section 2A and the serrations 10D of the guide section 2B each have a sawtooth wave form configuration and the two sawtooth wave forms are substantially mirror-symmetrical relative to each other, however so as to provide a certain overlap 10E between respective wave form flanks to guide the movement of the two sections 2A and 2B relative to each other when the passage area of the guide passages 10 is to be changed. In FIG. 1 the cross sectional area of the guide passage 10 is at its minimum for guiding the needle 5. The cross-sectional area of the passage 10 can be increased by loosening a connector such as a clamp or screw 20 and shifting the second guide section 2B as indicated by the arrow 22 in FIGS. 2 and 3. In FIG. 1 the needle eye 13 will be able to clear the passage 10 because once the guide bushing 6 has cleared its respective socket 4, the whole cassette 8 can be turned and with the clamp 20 loosened there will be sufficient play so that also the needle section 5B can be turned in the now enlarged guide passage 10 for the needle eye 13 to be withdrawn through the widened passage without the need for completely removing the second section 2B from the first section 2A.

Figure 2:
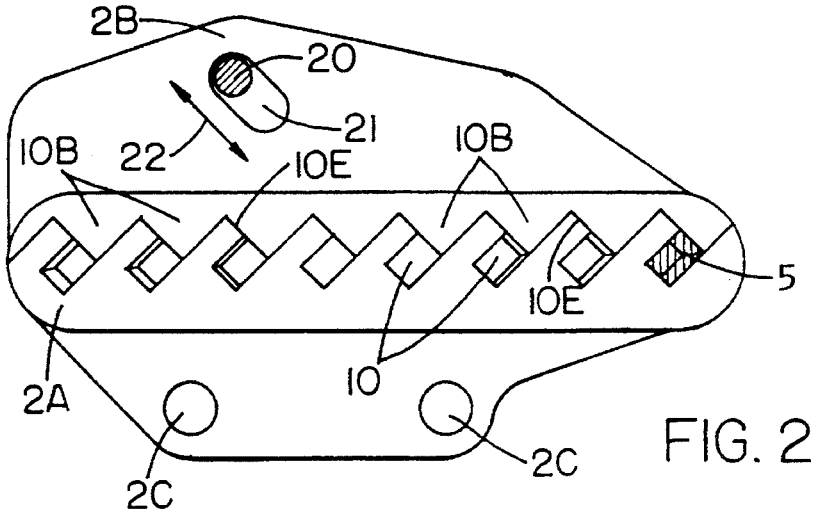
FIG. 2 shows a plan view of a guide and carrier member of the carrier and guide mechanism with its sections in a needle guide position.
Figure 3:
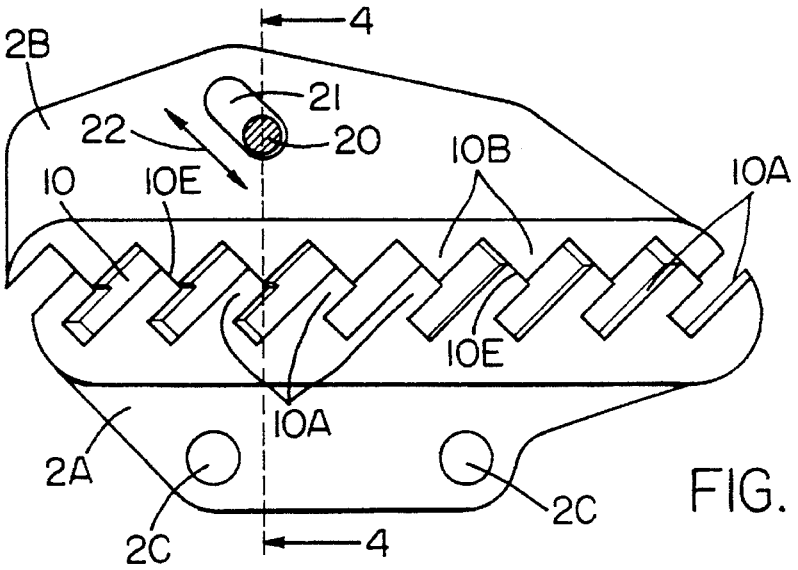
FIG. 3 is a view similar to that of FIG. 2, however showing the sections of the carrier member in a needle release position.

Referring to FIGS. 2 and 3 the guide member 2 carried below the carrier member 1 by the connector rod 3, is also so constructed that the straight guide passages 10 for the needles 5 are variable in their cross-sectional area, however with differently shaped saw teeth 10A in guide section 2A. In FIG. 2 the passages 10 have their minimal cross-sectional area just sufficient to provide a guiding sliding fit between the needle sections 5B and the side walls of guide passages in the guide member 2. In FIG. 3 the passages 10 have their largest cross-sectional area for the insertion or removal of a needle 5 including its needle eye 13.

Figure 4:
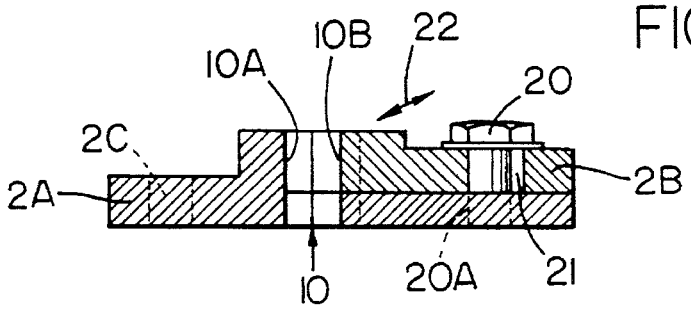
FIG. 4 is a view along section line IV—IV in FIG. 3.

In FIGS. 2, 3 and 4 the guide member 2 also comprises the first guide section 2A and the second guide section 2B. The first section 2A has holes 2C one or the other of which is used for rigidly securing the guide member section 2A to the lower end 3A of the connector rod 3. The first guide section 2A is provided with different serrations 10A and the guide section 2B is also provided with serrations 10B similar to serrations 10D in FIG. 1. The serrations 10A and 10B cooperate with each other in defining the passage area of the guide passages 10 by displacing the guide section 2B relative to the first guide section 2A as indicated 20 by the double arrow 22. For this purpose the section 2B can be loosened by loosening the clamping device 20 such as a screw that engages a threading 20A in the first guide section 2A, whereby the guide section 2B can be moved since the clamping member 20 passes through the elongated hole 21 in the second guide section 2B as seen in FIGS. 2, 3, and 4. Once the proper position of the two sections 2A and 2B relative to each other is achieved, the clamping member 20 is tightened again. The serrations 10A have a wave form or shape approximating a slanted square wave while the serrations 10B have a sawtooth wave form. These shapes 10A and 10B are so correlated to each other that the guide passages 10 can be increased or decreased in size as shown in FIGS. 2 and 3 and as just described. This operation is simple since it just requires the loosening and tightening of the clamping device 20 and a single motion in the direction of the arrow 22 either increases or decreases the cross-sectional area of all passages 10 simultaneously. Incidentally, the embodiment of the guide member 2 of FIGS. 2, 3, and 4 also has an overlap 10E for guiding the sections 2A and 2B relative to each other during the adjustment movement.

Figure 5:
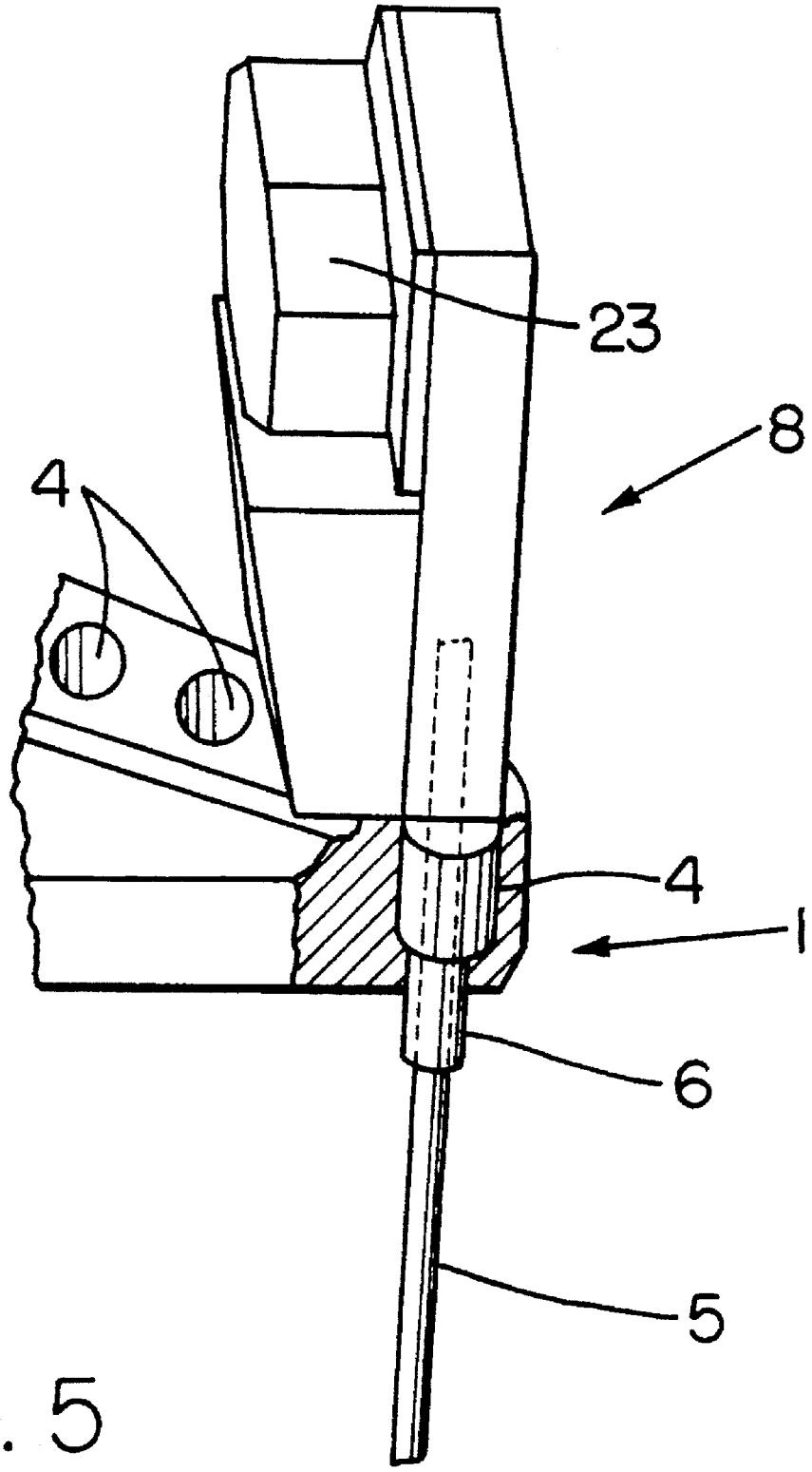
FIG. 5 shows a section through one of the guide sockets illustrated in FIG. 1.

FIG. 5 shows a section through one of the guide bores 4 in FIG. 1. Each guide bore is a through bore has a through the carrier member 1. The through bore has a shoulder forming a positive axial stop for the respective guide bushing 6 of the corresponding cassette housing 7.

Although the invention has been described with reference to specific example embodiments, it will be appreciated that it is intended to cover all modifications and equivalents within the scope of the appended claims.

What is claimed is:

1. An apparatus for presenting weft threads to a weft thread insertion member (17) in a loom, comprising a plurality of weft thread presenting needles (5), a number of individual, separate insert cassettes (8), each cassette comprising a weft selector and needle moving device as part of said insert cassette, each cassette being adapted for carrying at least one of said weft presenting needles (5), a carrier and guide mechanism (1, 2, 3, 4, 18) for carrying a plurality of said insert cassette (8), each of said insert cassette (8) comprising its own electric motor (23) for moving said at least one weft presenting needle into and out of a weft presenting position, said electric motor (23) forming part of said needle moving device of a respective insert cassette, and wherein said carrier and guide mechanism (1, 2, 3, 4) comprises a cassette carrier member (1) for carrying a plurality of said insert cassettes, a needle guide member (2), and a mounting (3, 15, 18) for holding said cassette carrier member (1) and said needle guide member (2) in an adjustable relationship to each other.

2. The apparatus of claim 1, further comprising first straight guides (4) in said cassette carrier member (1) and second straight guides (10) in said needle guide member (2) for individually guiding each of said weft thread presenting needles, each of said weft thread presenting needles having a needle eye (13) for a respective weft thread, said cassette carrier member (1) extending with its length at a slant relative to a motion direction of said weft thread insertion member (17), said first and second straight guide members (4, 10) having longitudinal axes extending with a skew in space in such a way that said weft thread presenting needles (5) are positioned in a fan-type plane twisted in space in which said weft thread presenting needles (5) are axially displaceably guided, and so that said needle eyes (13) of said weft thread presenting needles in a weft presenting position are crowed close to each other along a straight line (14) extending next to and substantially parallel to a path of said weft thread insertion member (17).

3. The apparatus of claim 2, wherein each of said first straight guides (4) in said cassette carrier member (1) comprises a guide socket and a guide bushing (6) in said guide socket, each of said insert cassettes (8) having a housing (7) for holding the respective electric motor (23), said guide bushing (6) extending out of said housing (7) and at least partly through said guide socket (4) for axially guiding the respective weft thread insertion needle (5) in said bushing (6) and for axially guiding said bushing (6) in said guide socket (4).

4. The apparatus of claim 3, wherein said second straight guides comprise straight guide passages (10) positioned in said needle guide member (2), each of said straight guide passages (10) being axially aligned with a respective guide bushing (6) in said cassette carrier member (1) for guiding a respective thread presenting needle (5).

5. The apparatus of claim 4, wherein each thread presenting needle (5) has a first section (5A) with a round cross-section guided in said bushing (6) and a second section (5B) with a rectangular cross-section guided in said straight guide passage (10).

6. The apparatus of claim 3, wherein said socket (4) has a through-bore with a shoulder in said through-bore forming a positive axial stop for said guide brushing (6).

7. The apparatus of claim 2, wherein said needle guide member (2) comprises a base section (2A) connected to said mounting (3) and an adjustment section (2B) adjustably connected to said base section (2A), said base section comprising first straight guide grooves (10A) each forming a portion of a straight guide passage (10), said adjustment section (2B) comprising second straight guide grooves (10B) each also forming a portion of a respective straight guide passage (10) in cooperation with a respective first straight guide groove (10A), a releasable connector securing said adjustment section (2B) and said base section (2A) to each other so that said sections are movable relative to each other when said connector is released for increasing a cross-section of said straight guide passages (10) and inserting or removing said weft presenting needle from a respective guide passage (10), and for reducing said passage cross-section for guiding said weft presenting needle (5).

8. The apparatus of claim 7, wherein said first straight guide grooves (10A) and said second straight guide grooves (10B) comprise serrations forming said portions of said straight guide passage (10).

9. The apparatus of claim 7, wherein said connector comprises in one of said base section (2A) and said adjustment section (2B) a longitudinal guide (21) and in the other of said base section and said adjustment section a releasable clamping member (20) engaging said longitudinal guide (21), said releasable clamping member having a released position for permitting a position adjustment of said sections relative to each other, said releasable clamping member having a tightened position for securing said sections to each other to define said straight guide passage (10).

10. The apparatus of claim 1, further comprising a control (24) for said electric motor (23), said control forming part of the respective insert cassette.

11. The apparatus of claim 9, further comprising a cassette housing (7) for each of said insert cassettes (8), said electric motor (23) and said control (24) being supported by said cassette housing (7).

12. A weft presenting needle guide for loom, comprising a base section (2A) for connection to a mounting, and an adjustment section (2B) adjustably connected to said base section (2A), said base section comprising first straight guide grooves (10A) each forming a portion of a respective straight guide passage (10), said adjustment section (2B) comprising second straight guide grooves (10B) each also forming a portion of a respective straight guide passage (10) in cooperation with a respective first straight guide groove (10A), a releasable connector securing said adjustment section (2B) and said base section (2A) to each other so that said sections are movable relative to each other when said connector is released for increasing a passage cross-section of said straight guide passage (10) and inserting or removing said weft presenting needle (50 from a respective guide passage (10), and for reducing said passage cross-section for guiding said weft presenting needle.

13. The weft presenting needle guide of claim 12, wherein said first (10A) and second (10B) straight guide grooves comprise serrations forming said portions of said straight guide passage (10).

14. The weft presenting needle guide of claim 13, wherein said serrations have mirror-symmetrical sawtooth configurations.

15. The weft presenting needle guide of claim 13, wherein said serrations have non-symmetrical waveform configurations.

16. The weft presenting needle guide of claim 11, wherein said connector comprises in one of said base section (2A) and said adjustment section (2B) a longitudinal guide (21) and in the other of said base section and said adjustment section a releasable clamping member (20) engaging said longitudinal guide (21), said releasable clamping member having a released position permitting a position adjustment of said sections relative to each other, said releasable clamping member having a tightened position securing said sections to each other to define said straight guide passage (10).

17. An insert cassette for presenting weft threads to a weft thread insertion member in a loom, comprising a cassette housing (7), a weft selector and needle moving device (8) in said cassette housing (7), at least one weft presenting needle (5) movably mounted in said cassette housing and extending out of said cassette housing, and at least one guide bushing (6) connected to said cassette housing for securing said housing to a cassette carrier member, said weft presenting needle extending through said guide bushing (6), so that said guide bushing guides said cassette housing relative to said cassette carrier member and said weft presenting needle (5) relative to said cassette housing, an electric motor (23) carried by said housing for moving said weft presenting needle (5), and control (24) carried by said housing for controlling said electric motor (23).

18. The insert cassette of claim 17, wherein said electric motor (23) and said control (24) are attached to one side of said housing.

* * * * *

UNITED STATES PATENT AND TRADEMARK OFFICE

CERTIFICATE OF CORRECTION

PATENT NO. : 5,458,163

DATED : Oct. 17, 1995

INVENTOR(S) : Walter Lindenmueller et al.

It is certified that error appears in the above-identified patent and that said Letters Patent is hereby corrected as shown below:

Column 1, line 35, insert a paragraph spacing after "needles.";
Column 6, line 8, delete "has a";
Column 6, line 25, replace "cassette" by --cassettes-- (both instances);
Column 7, line 45, replace "9" by --10--;
Column 7, line 49, after "for" insert --a--;
Column 8, line 10, replace "(50" by --(5)--;
Column 8, line 24, replace "11" by --12--.

Signed and Sealed this

Second Day of January, 1996

Bruce Lehman

*Attest:*

BRUCE LEHMAN

*Attesting Officer*

*Commissioner of Patents and Trademarks*